United States Patent [19]

Howell

[11] 4,424,731

[45] Jan. 10, 1984

[54] PERCUSSION GENERATOR HAVING SNUB CONTROL

[75] Inventor: Stephen L. Howell, Huntingburg, Ind.

[73] Assignee: Kimball International, Inc., Jasper, Ind.

[21] Appl. No.: 283,275

[22] Filed: Jul. 14, 1981

[51] Int. Cl.[3] ..... G10H 1/02

[52] U.S. Cl. ..... 84/1.26; 84/1.01; 84/1.13; 84/DIG. 12

[58] Field of Search ..... 84/1.03, 1.01, DIG. 12, 84/1.26, 1.13, 1.24

[56] References Cited

U.S. PATENT DOCUMENTS

| | | | |
|---|---|---|---|
| 3,227,799 | 1/1966 | Holman et al. | 84/1.26 |
| 3,244,790 | 4/1966 | Sharp | 84/1.13 |
| 3,446,904 | 5/1969 | Brand et al. | 84/1.13 |
| 3,480,719 | 11/1969 | Schwartz et al. | 84/1.26 |
| 3,519,723 | 7/1970 | Wiest | 84/1.26 |
| 3,610,806 | 10/1971 | Deutsch . | |
| 3,816,637 | 6/1974 | Whitefield | 84/1.24 |
| 3,935,783 | 2/1976 | Machanian et al. | 84/1.21 |
| 3,971,284 | 7/1976 | Schreier | 84/1.26 |
| 3,981,217 | 9/1976 | Oya | 84/1.03 |
| 4,012,982 | 3/1977 | Southard | 84/1.01 |
| 4,022,098 | 5/1977 | Deutsch et al. | 84/1.01 |
| 4,079,650 | 3/1978 | Deutsch et al. | 84/1.26 |
| 4,085,643 | 4/1978 | Griffith | 84/1.01 |
| 4,134,320 | 1/1979 | Oya | 84/1.01 |
| 4,205,582 | 6/1980 | Howell et al. | 84/1.26 |
| 4,332,183 | 6/1982 | Deutsch | 84/1.26 |

*Primary Examiner*—F. W. Isen

*Attorney, Agent, or Firm*—Jeffers, Irish & Hoffman

[57] ABSTRACT

A percussion generator for an electronic musical instrument, such as an electronic organ, wherein the percussion generator is responsive to a time division multiplexed serial data stream produced by scanning the keys of the keyboard. A control pulse is produced each time that a new key on the keyboard is depressed, and this pulse, which has a duration equal to or greater than a plurality of scans of the keyboard, is employed to produce a burst of keydown pulses in the data stream. The percussion generator is responsive to the serial data stream and each of the aforementioned control pulses to produce keydown pulses in the appropriate time slots of the data stream in a plurality of successive sequences thereof and then terminate the keydown pulses even though the associated keys remain depressed. A recirculating register dynamically stores those keydown pulses which have been blocked from the demultiplexer as long as the associated keys remain depressed, so that as new keys are depressed and new control pulses generated, the tones associated with the previously depressed keys will not again sound. A snub control is provided so that, in the event a number of keys are pressed in rapid succession as in a glissando, their sustains will not overlap to the point that a blurring of the sound occurs. Snubbing is accomplished by causing the keyers to convert from a long to a short decay state during the occurrence of the aforementioned control pulses.

20 Claims, 8 Drawing Figures

Δ DATA GENERATOR
62 4 BIT RAMS
HI C
LOC
Δ DATA
0
1
2
3
58
59
60
61
φ 1 READOUT
φ 2 WRITE IN
HF CLOCK
ADD 1 BINARY CIRCUIT
FORCE "0000"
ENABLE
FORCE "0001"
ENABLE
DECODE "0" AND "6"
0000
0110
DATA
(COUNT 61)
COUNT 62
Δ DATA RAM ENABLED = 1
SERIAL DATA
5 SCANS=10 ms
Δ DATA
COUNT 61
T6
K7
MPX RECEIVERS
COUNT DECODING AND GATES
MPX DRIVERS
158
160
162
164
166
168
170
172
174
176
178
180
182
184
186
188
190
192
194
196
198
24

PERCUSSION GENERATOR HAVING SNUB CONTROL

BACKGROUND OF THE INVENTION

The present invention relates to a system for generating percussive sounds in an electronic organ, such as those produced by a piano, harpsichord, banjo and the like. More particularly, the invention is concerned with a percussion generator of this type which is responsive to a multiplexed serial data stream.

Percussive instruments, such as pianos and harpsichords, produce a sound which has a relatively fast attack and a sustain of limited duration. In the case of a piano, for example, when one of the keys is depressed, the sound rapidly attacks to the maximum, decays rapidly to a sustain level and then sustains gradually as the key continues to be held. In a harpsichord, the sustain is much shorter because the strings are plucked rather than struck. A characteristic of all percussive instruments of this type is that the sustain is of limited duration, and even though the key may be held depressed for a long period of time, the sound will decay completely in a relatively short interval.

In electronic organs, the generation of tones is controlled by switches that are actuated by depression of the keys of the keyboard, and for most voicing, as long as the key is held depressed the tone will continue at substantially the same amplitude until the key is released. In order to simulate percussive sounds, then, it is necessary to provide for an attack and decay envelope that is limited in duration, regardless of whether or not the key continues to be held, and yet produce the tone again if the key is released and again depressed. Prior electronic organs employed resistor-capacitor circuits for supplying the keyers with an envelope voltage which is applied only momentarily to simulate the percussive effect, even though the keys are held for a longer period of time than that necessary to produce the percussive attack and decay. A significant disadvantage to utilizing this technique is that a separate percussion circuit must be provided for each of the keyers, and the large number of keyers which must be supplied results in a substantial additional cost if percussion effects are to be provided for all of the tones capable of being played by the organ. Additionally, there is the problem of matching the elements of the resistor-capacitor percussion circuits so that they will produce uniform percussive effects.

For some time now, the keyboards of electronic organs have been multiplexed in an attempt to reduce the number of wiring connections between the keyboard and the keyers associated with it. In an organ of this type, the keys of the keyboard are sequentially scanned and a time division multiplexed serial data stream is produced wherein time slots in the data stream correspond to respective keys of the keyboard and a pulse or other keydown signal will appear in that time slot corresponding to a depressed key. In many multiplexed organs, however, it was still necessary to utilize discrete RC percussion circuits for each of the keyers in order to produce the percussion sounds.

U.S. Pat. No. 4,012,982 provides one solution to the problem of economically providing for percussion in a multiplexed organ. In this system, a delay circuit comprising a shift register having a delay period equal to an integer multiple of the number of time slots in the multiplexed data stream delays the data stream and then recombines it with the undelayed data stream in a gate. The output of the gate is a time division multiplexed signal with pulses in time slots corresponding to the time slots of the multiplexed signal applied to the shift register, but from which pulses are deleted after one or more scans of the manual. The net result is that a burst of keydown pulses are produced for a time period equal to the delay provided by the shift register. Although this system is effective in greatly reducing the cost of providing percussion effects, it has a disadvantage in that the duration of the burst cannot easily be controlled, since it is directly proportional to the length of the shift register delay. Additionally, if longer bursts are desired, a shift register of excessively long length is required, thereby adding significantly to the cost of the percussion circuit.

One disadvantage to generating percussion by means of a burst of keydown pulses over a fixed time interval is not being able to provide a snub effect, which is the rapid decay produced when a piano key, for example, is released before the sustain has decayed out. In a multiplex percussion generator, the burst of tones is applied to regular sustain keyers, which produce the type of attack and decay which are desired to simulate the instrument in question. Since the tone production is generally independent of whether or not the key is released or remains depressed, however, the sustain characteristics will be the same for all notes, regardless of how they are played on the keyboard.

A further disadvantage to producing percussion through a burst of keydown pulses over a fixed interval is the overlap of the sustains of a large number of the notes if the notes are played very rapidly in succession. For example, if a glissando is played by rapidly drawing the finger across the keyboard so that the notes are played in rapid succession, before one note decays out, the next note begins to attack so that very quickly the output circuitry is loaded with tones of different pitches and decaying out at different times. This problem is particularly troublesome in the percussion generator of the present invention wherein the interval of time during which the burst of keydown pulses is produced is lengthened if two notes are played in such rapid succession that the second note is played before the "delta data" pulse produced each time a new key is depressed has terminated. This results in a substantial increase in the sustain times of each of the notes so that an unnatural and unpleasing glissando effect results.

SUMMARY OF THE INVENTION

The present invention overcomes the problems and disadvantages of the prior art systems identified above by providing a burst of keydown pulses in a time interval which is determined by a control pulse which itself has a fixed duration and is produced each time a new key of the keyboard is depressed or a previously depressed key is released and then again depressed. The advantage to controlling the burst of percussive keydown signals in this manner is that the length of the control pulse can be varied, depending on the particular percussive instrument which is simulated. Additionally, since the length of percussive burst is controlled by a pulse not depending on the serial data stream for its length, the long delay lines associated with the system of the aforementioned U.S. Pat. No. 4,012,982 are avoided.

The percussive burst is produced by gating selected keydown pulses in the serial data stream obtained from scanning of the keyboard. One input to the gating circuit carries the multiplexed serial data stream and one of the control inputs carries the delta data pulse, which is a pulse that is produced each time a different key of the keyboard is depressed or a previously depressed key is released and again depressed. The delta data pulse is of a nominal length, such as ten milliseconds, but in any event is longer than one scan of the manual and is preferably five scans in length. It will be appreciated, however, that the length of the delta data pulse in relation to the length of a scan on the manual will depend on the speed of the multiplex clock used in a particular organ.

When a key of the keyboard is depressed, the delta data pulse is initiated and a keydown pulse appears in the appropriate time slot of the serial data stream. The aforementioned gating circuit gates these two signals together and transmits the keydown pulse to the demultiplexer wherein the serial data stream is demultiplexed and the appropriate keyer or keyers actuated. On the next scan of the manual, the pulse is again passed by the gating circuit, and this continues until the end of the delta data pulse, at which time the gate is disabled from passing data to the demultiplexer and the percussion burst is terminated. In a well-known manner, the demultiplexer demultiplexes the keydown pulses and produces a DC keying voltage. The keyer chip is controlled by this voltage and applies an exponential attack and decay or sustain envelope to it characteristic of the percussive voice with which the keyer chip in question is associated.

Even though the key in question may remain depressed, after sustain is completed, no further tone or tones will be produced. If another key is depressed while the first-mentioned key remains depressed, however, a new delta data pulse will be produced and this will enable the gating circuit to pass the keydown pulses for the new key during the interval defined by the delta data pulse. Since the gating circuit is responsive to the entire serial data stream, however, some means must be provided to distinguish the keydown pulse for the last depressed key from those resulting from previously depressed keys which are still held, although their tones have decayed out. This is accomplished by recirculating keydown pulses relating to prior percussion bursts in a recirculating register as long as they continue to appear in the data stream on each scan of the manual. The recirculating register, which is synchronized with the serial data stream, has its output connected to a comparator which compares the recirculated data with the incoming data stream, and if there is a match between the recirculated data and the incoming data for a particular time slot, the gating circuit is disabled for that time slot so that the keydown pulse is not transmitted to the demultiplexer, wherein it would cause reattacking of that note. For those time slots where there is not a match between the recirculated data and the incoming data, however, the gating circuit is enabled to connect the keydown pulses to the demultiplexer as long as the delta data pulse is present at its control input. When the delta data pulse terminates, the gating circuit is then enabled to load the pulse into the recirculating register which "remembers" those notes which have already been played and their delta data pulse has terminated, but are still appearing in the serial data stream due to the associated keys remaining depressed.

Specifically, the present invention relates to an electronic musical instrument, such as an electronic organ, including a keyboard, a multiplexer for repeatedly scanning the keyboard and producing a time division multiplexed serial data stream comprising a cyclically repeating sequence of time slots associated respectively with the keys and pulses in those time slots associated with depressed keys. A demultiplexer demultiplexes the data stream, and a keyer and tone generator means responsive to the demultiplexer produces selected tones. A new keydown detect circuit is responsive to key actuation for producing a control pulse each time a key not already depressed is depressed and has a duration longer than a single scan of the keyboard. The percussion generator of the present invention is interposed between the multiplexer and demultiplexer and comprises a data input connected to the serial data stream, a control input operatively connected to the new key detect means to receive the control pulse, and an output operatively connected to the demultiplexer. A gating circuit responsive to the control pulses and to the data stream passes to the output each keydown pulse in the data stream which first appears in the data stream substantially at the same time as a currently occurring control pulse is present on the control input and continues to pass each keydown pulse only as long as the current control pulse is present on the control input.

As discussed earlier, a problem occurs with the percussion generator of the present invention when a number of keys are played in very rapid succession, as when playing a glissando. In this case, the adjacent keys may be played in such rapid succession that the next key will be actuated before the delta data pulse for the previously actuated key has terminated, and since a new delta data pulse will be produced, this has the effect of extending the width of the prior delta data pulse. In the case of a glissando, this effect can result in a delta data pulse which is much longer than the 10 millisecond pulse desired and results in very long sustains which overlap and produce a musically unpleasant result.

In order to prevent this, another aspect of the present invention provides a snub control system which switches the keyers to a medium short sustain state as long as a delta data pulse is being produced. The medium short sustain causes the sustain for each note to be substantially shortened so that there is minimal overlap between the sustains of successively played notes. If, however, only one note is played or the notes are played in succession sufficiently slow that the delta data pulse for one note terminates prior to the initiation of the delta data pulse for the next note, then normal sustain remains in effect. Additionally, the snub system is responsive to a situation where no keys are depressed, as would be the case if a single key is depressed and then released prior to the completion of sustain, as in the case of a piano sound. A characteristic of a piano is that when the key is released snub occurs with its characteristic short sustain, and the snub control system of the present invention is responsive to this condition to convert the keyer to a medium short sustain on key release, assuming that no other keys remain depressed.

By stretching the delta data pulse so that its time interval encompasses not only the attack portion of the envelope but also the initial part of the sustain, an overshoot condition simulative of a piano sound results. This overshoot condition provides for very rapid decay immediately following attack and then a transition into a normal sustain, which is much more gradual. If the notes are played monophonically, the characteristic snub produced by release of the key can also be realized.

In order to employ the snub system of the present invention, a keyer of the type having means for controlling the sustain length is used. Such a keyer system is disclosed in U.S. Pat. No. 4,217,801 owned by Kimball International, Inc., and which is expressly incorporated by reference in the present application. The keyer disclosed in this patent produces attack and sustain by means of a switched capacitor technique wherein the slope of the attack and sustain is controlled by varying the switching frequency applied to the electronic switches employed in the switched capacitor keyer. If desired, the slope could also be controlled by switching in capacitors of different sizes, although the frequency variation technique is preferred.

Modification of the switching frequency can be conveniently controlled from a binary data selection circuit, which selects various outputs of a counter or encodes the outputs of a polynomial counter, for example.

Thus, normal decay can be achieved by applying a lower frequency to the switching field effect transistors, and when the medium short sustain utilized for snubbing is desired, a different binary control signal is applied thereby causing a higher frequency switching signal to be connected to the field effect transistors.

This aspect of the present invention contemplates an electronic musical instrument, such as an electronic organ, comprising a keyboard having playing keys, a percussion generator responsive to the depression of the keys for producing percussion keying signals corresponding to the depressed keys, and a tone generator-keyer responsive to the keying signals for producing tones of frequency corresponding to the keying signals. The improvement is an envelope control circuit connected to the tone generator-keyer comprising means for controlling the tone generator-keyer to impart an amplitude envelope to the tones produced thereby having an attack portion of increasing amplitude and a decay portion of decreasing amplitude, the means for controlling including selection means for selecting a sustain portion of either relatively long duration or of relatively short duration. There is provided means responsive to the depression of a key not already depressed for producing a control pulse, and the selection means is responsive to the control pulse for selecting short sustain for the duration of the control pulse.

It is an object of the present invention to provide a percussion generator for an electronic organ or other electronic musical instrument which avoids the necessity for discrete percussion keyers associated respectively with each percussion tone played by the organ.

It is another object of the present invention to provide a percussion generator responsive to a time division multiplexed serial data stream wherein the burst of keydown pulses that actuate the keyer have a cumulative duration controlled by an independently produced control pulse, which may have its duration varied.

It is yet another object of the present invention to provide a snub control circuit for switching the keyers to short sustain during the aforementioned control pulse so that overlapping of the sustains of a large number of the tones produced will not occur even though the keys are played in rapid succession.

These and other objects of the present invention will be apparent from the detailed description of a preferred embodiment of the invention when considered with the appropriate drawing figures.

DESCRIPTION OF THE PREFERRED EMBODIMENT

Figure 1:
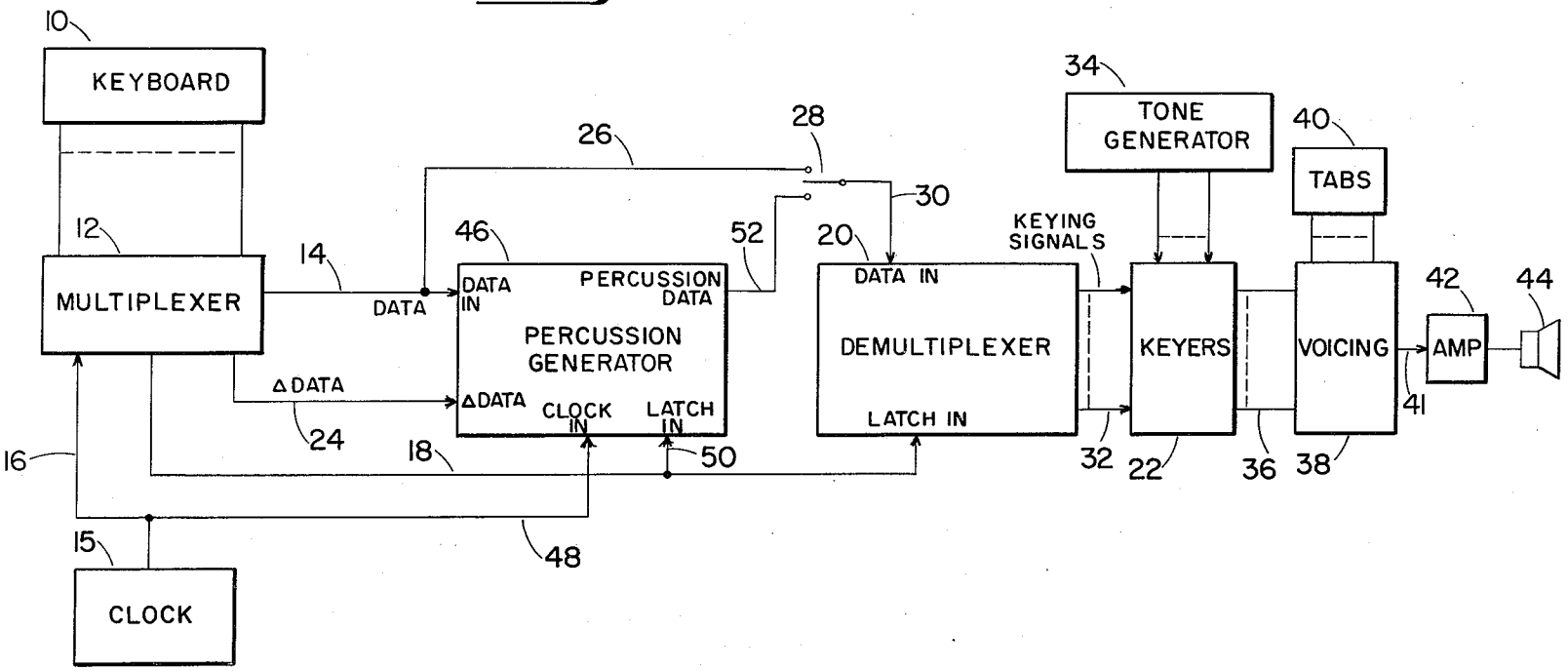
FIG. 1 is a simplified block diagram of an electronic organ including the percussion generator of the present invention.

Referring now to the drawings in detail, and in particular to FIG. 1, an electronic organ incorporating the present invention comprises a keyboard 10 which is multiplexed by multiplexer 12 to produce on line 14 a time division multiplexed serial data stream comprising a plurality of time slots corresponding on a one-to-one basis to the keys of keyboard 10 and including keydown pulses in those time slots corresponding to depressed ones of the keys. Multiplexer 12 is clocked by the system clock 15 over line 16 and produces on line 18 a latch pulse at the end of each scan of keyboard 10, which causes the demultiplexer 20 to latch the data into keyers 22. Multiplexer 12 produces on line 24 the "delta data" pulse, which is a ten millisecond pulse, for example, that occurs each time a new key is depressed or a key which was previously depressed is released and then again depressed.

The data from multiplexer output line 14 is connected by line 26, OR gate 28 and line 30 to the data input of demultiplexer 20, which may be of conventional design and functions to demultiplex the data. The demultiplexed data appears as DC keying signals on multiplexer output lines 32, which are connected to the inputs of keyers 22. Keyers 22 are of a conventional type and contained on large scale integrated circuit chips and are supplied with tones from tone generator 34. Keyer chips 22 impart the characteristic attack and sustain envelope to the tone selected from tone generator 34 and produce these enveloped tones on output lines 36, which are connected to voicing circuit 38. Voicing circuit 38 is controlled by tabs 40 and produces on line 41 the appropriately voiced tones, which are amplified by amplifier 42 and then connected to speaker 44. Thus far, the system shown in FIG. 1 is completely conventional, and although most current electronic organs include much additional circuitry between multiplexer 12 and the output keyers 22 for the purpose of modifying the serial data stream for certain effects, such as fill note generation and the like, such details are not necessary for an understanding of the present invention. Although the major circuit elements are shown as being directly connected to each other, the term "connected" as used in the present application does not imply a direct connection, and there could be considerable circuitry between adjacent blocks in the circuit. Thus, the term "connected" means operatively connected wherein the data or control signal is coupled from one unit to the other, either directly or through intermediate circuitry.

FIG. 1 also illustrates percussion generator 46, which has a data input connected to the serial data line 14 from multiplexer 12, a delta data input connected to line 24, a clock input connected to clock 15 through line 48, a latch input connected to line 18 by line 50, and a percussion output line 52 connected through switch 28 to the data input of demultiplexer 20. Although the percussion data stream on line 52 is shown as being switched alternatively with the data stream on line 26 from multiplexer 12, a separate bank of percussion keyers could be provided, in which case the percussion data on line 52 and the multiplexer data on line 26 would be connected to separate demultiplexers.

Figure 2:
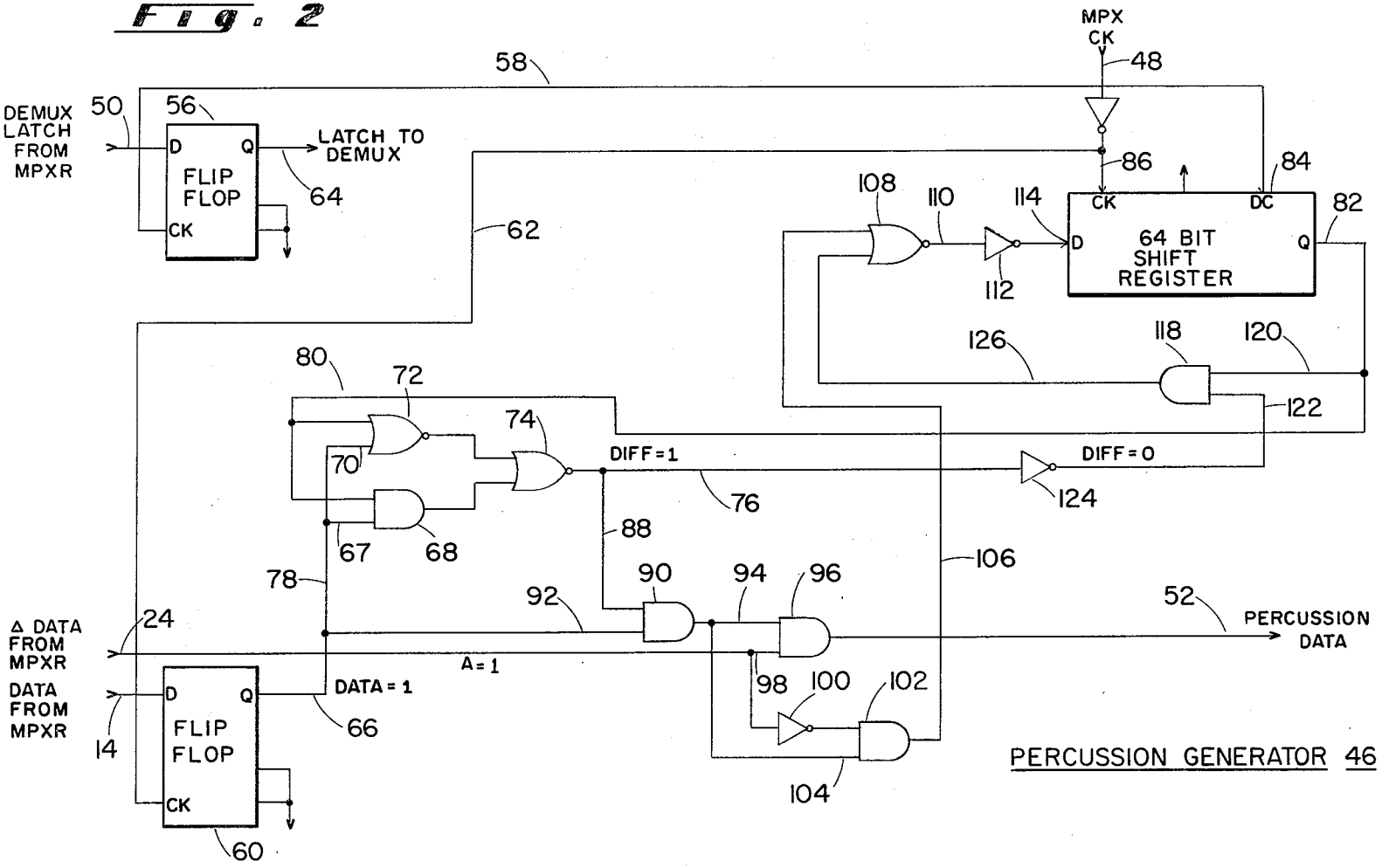
FIG. 2 is a detailed circuit schematic of the percussion generator.

Referring now to FIG. 2, the latch command is brought into percussion generator 46 on line 50 and is connected to the D input of flip-flop 56, which is clocked by the clock signal connected to the clocking input over line 58. The effect of flip-flop 56 is to delay the latch command by one clock cycle. The serial data from multiplexer 12 is connected to flip-flop 60 on line 14, and this flip-flop is clocked by the inverted multiplex clock train on line 62. The effect of flip-flop 60 is to delay the serial data on line 14 by one time frame, and since the latch command on the output 64 of flip-flop 56 is also delayed by one time frame, there is no effect on the operation of demultiplexer 20. The purpose of the delay provided by flip-flops 56 and 60 is to eliminate the effect of minute delays which occur upstream from the system.

The data stream on the Q output 66 of flip-flop 60 is connected to one of the inputs 67 of AND gate 68 and one of the inputs 70 of NOR gate 72. The outputs of gate 68 and gate 72 are connected to the inputs of NOR gate 74, and gates 68, 72 and 74 function as an exclusive OR circuit which produces a logic 1 on the output 76 of NOR gate 74 only when the logic level on line 78 differs from that of the recirculate output line 80.

Line 80 is connected to the Q output 82 of sixty-four bit shift register 84 and is connected to the other inputs of NOR gate 72 and AND gate 68. Sixty-four bit shift register 84 is clocked by the inverted multiplex clock train on line 86, and the length of shift register 84 is exactly the same as the length of one scan of the keyboard 10.

The output of NOR gate 74 is connected by line 88 to one of the inputs of AND gate 90, and the other input thereof is connected by line 92 to the serial data output line 66 of flip-flop 60. AND gate 90 enables the serial data from the Q output of flip-flop 60 if it is enabled by the output of exclusive OR arrangement 68, 72 and 74, which occurs only when the serial data on line 78 is different from the data which is being circulated by shift register 84 and appears on output 82. The necessity for the recirculating shift register arrangement 84 arises because of the fact that the delta data pulse on line 24, which is much wider than a single clock cycle, is produced each time a new key is depressed or a previously depressed key is released and again depressed. If an earlier depressed key is still being held when a new key is depressed, and if data for both of these keys is presented to keyers 22, the first depressed key would sound again. In order to prevent this, incoming new data from flip-flop 60 is compared with the recirculating data which is representative of all keys presently depressed for which the respective delta data pulses have terminated, so that the new data is separated out for transmission to the keyers 22.

One of the inputs 94 of AND gate 96 is connected to the output of AND gate 90, and has its other input 98 connected to delta data line 24. Thus, AND gate 96 is enabled only during the ten millisecond delta data pulse, and all new data passed by AND gate 96 will be connected to output line 52 on each scan of keyboard 10. This, in effect, produces a burst of new data which, when it is utilized to control the sustain type keyers 22 disclosed in U.S. Pat. No. 4,217,801, produces a percussive effect.

The delta data pulse on line 24 is inverted by inverter 100 and serves to disable AND gate 102, the other input 104 of which is connected to the output of AND gate 90 to receive the serial data. At the end of the delta data pulse, however, AND gate 102 is enabled to pass the data stream from AND gate 90 over line 106 to the input of NOR gate 108. The output 110 of NOR gate 108 is connected through inverter 112 to the data input 114 of shift register 84. This arrangement loads new data into shift register 84 for recirculation at the termination of a delta data pulse so that the data which has just previously been transmitted to demultiplexer 20 is now dynamically stored.

Data is recirculated within shift register 84 by AND gate 118, which has one of its inputs 120 connected to Q output 82 of shift register 84 and its other input 122 connected to inverter 124, which has its input connected to the output 76 of exclusive OR arrangement 68, 72 and 74. The output 126 of AND gate 118 is connected to the other input of NOR gate 108. Recirculation of the data in shift register 84 is accomplished when AND gate 118 is enabled by exclusive OR arrangement 68, 72 and 74 each time there is a match between the incoming data on line 14 and the recirculated data at the output 82 of shift register 84. Thus, exclusive OR arrangement 68, 72, 74 enables AND gate 118 for recirculation if it sees that a previously depressed key which has already had its burst of keydown data sent to demultiplexer 20 remains depressed, and disables AND gate 118 whenever there is no match between the new data and the recirculated data.

With additional reference to FIG. 8, the operation of the percussion generator of FIG. 2 will be described. The first wave form 130 represents the multiplex clock train produced by clock 15 and will be seen that major portions of the wave form have been deleted for the sake of simplicity. Wave form 132 represents the latch command, which is a pulse 134 that occurs in time slot 61 on each scan of the keyboard 10. The third wave form 136 represents keydown data, which is a pulse 138 produced by multiplexer 12 on input line 14 as it scans the top key of keyboard 10, which key is depressed. This pulse 138 will occur in the time 0 time frame on each scan of keyboard 10, and since no other keys are depressed at this time, no other pulses appear on line 14.

As soon as pulse 138 appears in the data stream, the delta data pulse 140 is produced by an appropriate circuit, which will be described at a later point. Delta data pulse 140 is shown as being two scans wide for the sake of simplicity, although it could be wider in actual practice. Delta data pulse 140 enables AND gate 96 and disables AND gate 102 thereby producing on output line 52 the percussion data pulses 142 which are illustrated in FIG. 8, and which occur in time slots 0 in synchronism with the data input pulses 138 and the clock train 130. As illustrated, when delta data pulse 140 is terminated, AND gate 102 is then enabled and AND gate 96 is disabled, so that the percussion data pulses disappear as shown in FIG. 8. Since AND gate 102 is enabled, however, pulses in these time frames are loaded into shift register 84 through NOR gate 108, and the pulses are recirculated in their proper time frames on each scan of the manual as illustrated by wave form 144. After the termination of the keydown pulse burst 142, the appropriate keyer 22 will cause the tone on output line 36 to decay exponentially in a manner well-known in the art. The output of NOR gate 74 is shown as pulses 146, which are in time synchronism with the data input pulses 138 and the percussion output pulses 142 and indicate that there is no match between the recirculated data and the new data coming into exclusive OR arrangement 68, 72 and 74. Beneath the recirculating pulses 144, it will be seen that the output of exclusive OR arrangement 68, 72, 74 is a logic 0, which enables continued recirculation of pulses 144 and disables AND gate 90 which carries the incoming data from the multiplexing of keyboard 10. Although keydown pulses in time slot 0 continue to appear on data input line 14 due to the continued depression of the associated key, corresponding pulses do not appear on the percussion data output line 52.

Subsequently, if the second highest key in time slot 1 is depressed, pulses 150 appear on data input line 14. This causes the occurrence of another delta data pulse 152 which enables AND gate 96. Since the incoming data is different from the data being recirculated, AND gate 90 is enabled by NOR gate 74 and corresponding output pulses 154 appear on output line 52 as percussion data. Even though the highest key remains depressed so that pulses 138 continue to appear on input line 14, they are matched with recirculating data pulses 144 and no corresponding percussion pulses are produced on line 52. When the second delta data pulse 152 terminates, two pulses 144 and 156 are recirculated in shift register 84 and percussion output pulses 154 cease.

The above operation continues as keys are continuously pressed and released, and the system is capable of polyphonic operation because it operates on the data on a time slot by time slot basis. As keys are released, the keydown pulses associated with them are no longer recirculated within register 84, and if these keys are again depressed, they will produce a new delta data pulse which will enable them to trigger a burst of data that is transmitted to demultiplexer 20.

Figure 3:
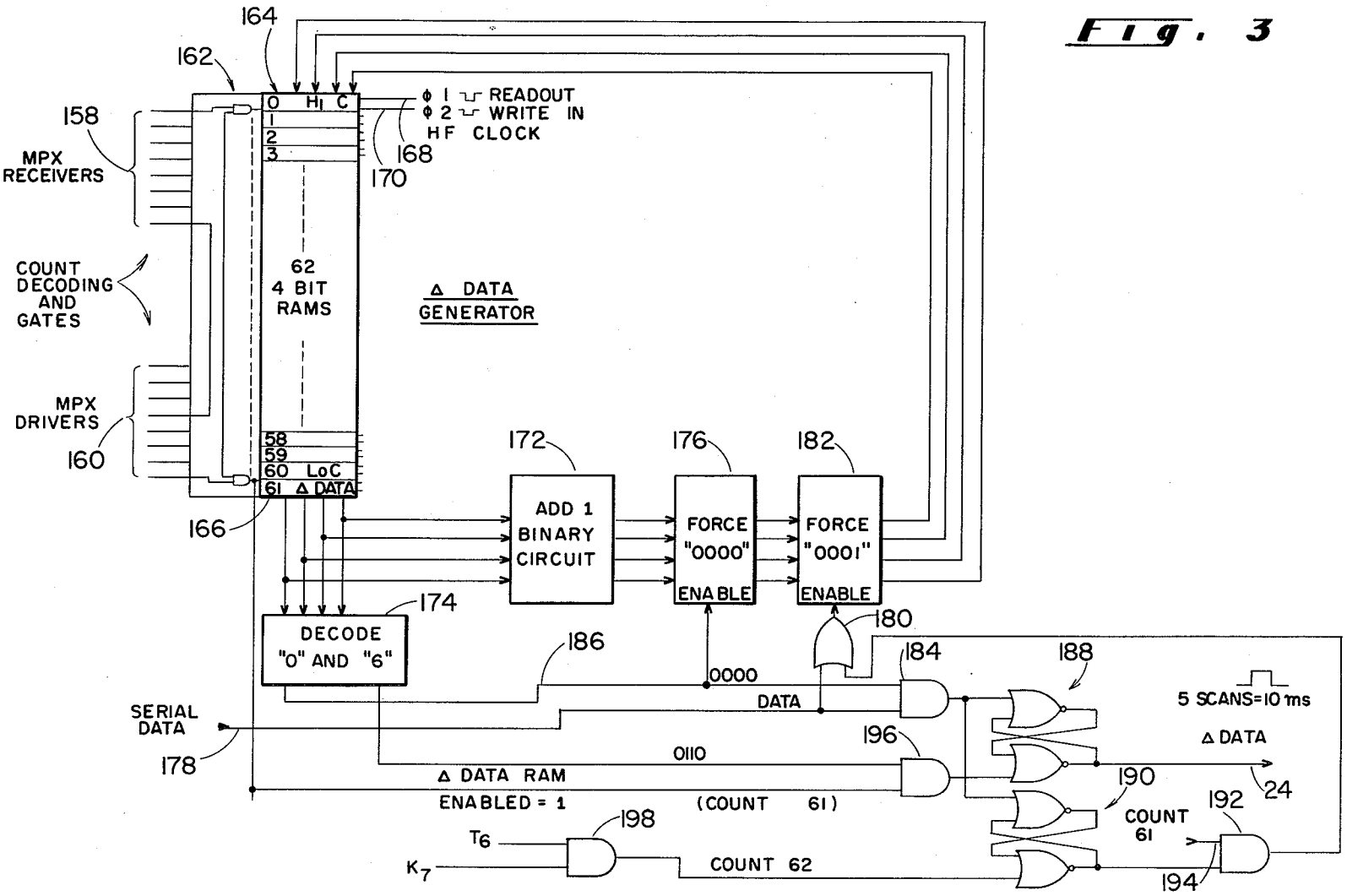
FIG. 3 is a schematic of an exemplary circuit employed to generate the delta data pulse.

FIG. 3 illustrates an exemplary circuit for generating the delta data pulse transmitted to the percussion generator 46 on line 24. The delta data generator comprises multiplex receiver lines 158 and multiplex driver lines 160 decoded by conventional AND gate 162 to sequentially enable sixty-two four bit RAM's 164, which correspond to the sixty-one keys of keyboard 10 with the last RAM 166 used for delta data counting. RAM's 164 and 166 are controlled by the high frequency clock on lines 168 and 170, wherein line 168 is the readout line during phase one of the clock, and line 170 is the write in control activated during phase two of the clock.

RAM's 164 are read out into a binary adder 172, which adds a binary 1 to the four bit binary word read out. For example, during scanning of the high C key, the top RAM location will be read into the binary adder 172, and during the next clock cycle the second location, which corresponds to high B on keyboard 10, will be read into it, and so forth. Also provided is a decoder 174 which decodes binary 0 and binary 6 for any of the RAM's 164 or 166.

During static operation when no keys are depressed, decoder 174 decodes 0 for each RAM and enables a Force 0000 block 176, which forces each RAM to a binary 0 during the write in phase of the high frequency clock. So, with no keys depressed, the RAM's 164 and 166 will eventually all have binary 0's contained in them and will remain that way until the key is depressed. Once a key is depressed, however, the serial data on line 178 is transmitted through OR gate 180 to Force 0001 circuit 182, which causes binary 1 to be written into that RAM being enabled at the time that the data pulse appears on line 178. The data pulse also activates AND gate 184, which is enabled by the decode 0 signal on line 186. This sets RS flip-flop 188, which initiates the delta data pulse on line 24.

Activation of AND gate 184 also sets RS flip-flop 190, which enables AND gate 192 so that when the decoded count 61 pulse appears on line 194 from the AND decoding 162, it activates block 182 thereby forcing binary 1 into RAM 166, which is the RAM used for counting the number of scans to define the length of the delta data pulse on line 24. On the next scan, the RAM location that represents the key that is being pressed will have a binary 1 in it, and when it is read, the Add 1 binary circuit 172 will increase that to a binary 2 but serial data via OR gate 180 will enable block 182 thereby forcing that binary 2 back to a binary 1 and hold binary 1 in that RAM location until the key is released.

RAM 166 containing the delta data count will increment by one each time the manual is scanned, and when binary 6 is decoded by block 174 and AND gate 196 is enabled by count 61, flip-flop 188 will be reset and the delta data pulse on line 24 will terminate. This results in a delta data pulse five scans wide, which is approximately ten milliseconds in an exemplary embodiment of the invention. Delta data RAM 166 will continue to count up until it reaches count 15 and then 0, and when it reaches 0 the zero decoder 174 will force 0 back into RAM 166 and it will remain there until another key is pressed.

If a second key is pressed during a delta data pulse, AND gate 184 will set flip-flop 188, but this will have no effect since it is already set. Flip-flop 190 will also be set so that count 61 will force delta data RAM 166 back to a binary 1. It will then take five scans from that time before the delta data flip-flop 188 can be reset, and this has the effect of stretching the delta data pulse beyond the nominal ten millisecond length. If any key is released, the serial data for that particular key will disappear from line 178 and block 182 will then be transparent so that the add one binary adder 172 will be effective and the RAM location for that particular data bit will count up through binary 15 and then back to binary 0. When 0 is decoded for that particular RAM, circuit 176 will hold that RAM at binary 0. This is the first time that a delta data pulse can be caused from that location since the key was released, and the time delay of fifteen scans provides key switch bounce immunity so that a new delta data pulse is not inadvertently initiated when the key is released. AND gate 198 decodes count 62 and resets flip-flop 190 on count 62 thereby disabling AND gate 192.

Figure 4:
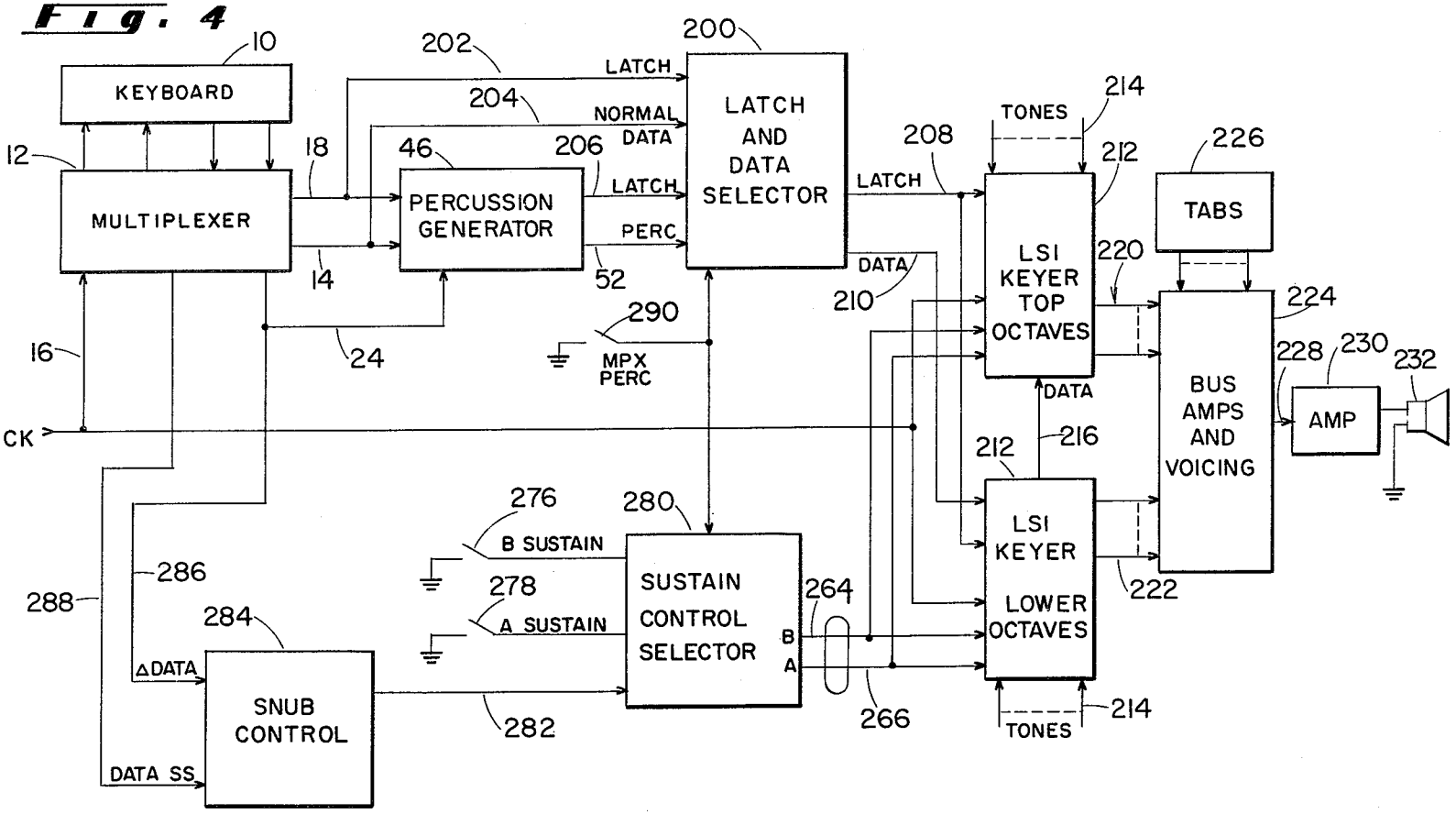
FIG. 4 is a block diagram of an electronic organ including the percussion generator and snub control of the present invention.

As discussed earlier, in multiplex percussion generators, the actuation of keys in rapid succession may result in such overlapping of their sustains that a musically unpleasant blurring effect results. The fact that the delta data pulse can be stretched by the data generator of FIG. 3 in the event that a second key is depressed before the delta data pulse for the first depressed key has terminated increases the sustain for the first depressed key thereby contributing to the sustain overlap. FIG. 4 illustrates a snub control circuit according to the present invention which has the effect of shortening the sustain in the event that the keys are played in rapid succession. Where possible, identical reference numerals have been used for the same circuit elements.

Latch and data selector 200 receives latch command on line 202 from multiplexer 12 and normal (non-percussion) data on line 204. It also receives latch command from percussion generator 46 on line 206 and percussion data on line 52, the latter being a burst of keydown pulses over the time interval established by the delta data pulse. Data selector 200 selects either normal latch and data or percussion latch and data and provides the selected latch command on line 208 and the selected data stream on line 210. Latch and data are fed to a pair of LSI sustain keyer chips 212, which are the types of keyers described in U.S. Pat. No. 4,217,801, which patent is expressly incorporated by reference in the present application. Keyer chips 212 perform both the demultiplexing function and the keying function and are fed by tones on lines 214. Data is connected to the lower keyer 212, which transmits the data over line 216 to the upper keyer 212 in a manner described in U.S. Pat. No. 4,217,801. When keyers 212 receive latch command on line 208, they convert the serial data to parallel format, key the appropriate tones from lines 214 with a sustain-type amplitude envelope and transmit the enveloped tones over lines 220 and 222 to bus amplifiers and voicing block 224, which is controlled by tabs 226. The output 226 of bus amplifiers and voicing block 224 is amplified by amplifier 230, the output of which is connected to speaker 232.

Keyer chips 212 impart the sustain envelope, which has an exponential attack portion and an exponential decay portion, to the tones by means of a switched capacitor technique wherein charge is incrementally transferred from one capacitor to another through a pair of serially connected electronic switches, such as field effect transistors. The duration of the attack and sustain is controlled by varying the frequency at which the field effect transistors are switched, with a higher frequency resulting in a more rapid transfer of charge and, therefore, a shorter attack or sustain, and with a lower frequency resulting in a longer attack and sustain.

Figure 7:
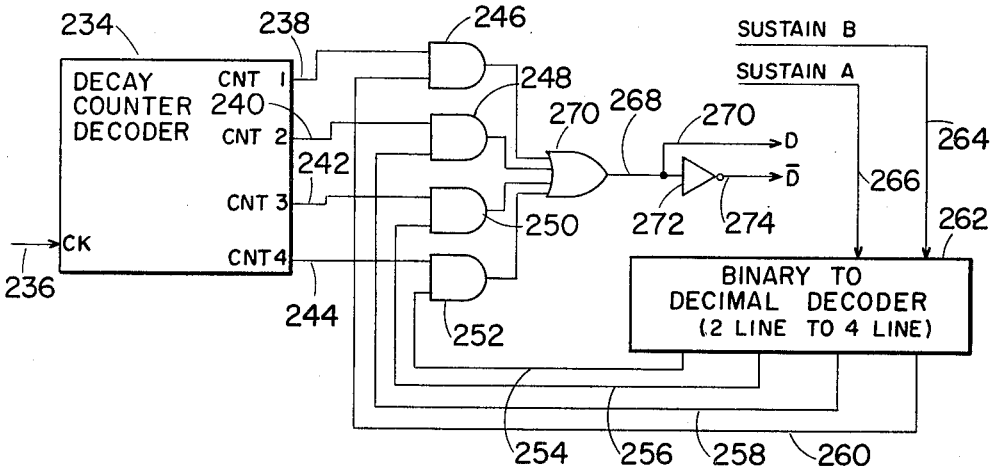
FIG. 7 is a schematic of the snub sustain selector.

FIG. 7 illustrates a suitable circuit for controlling the decay frequency utilized to clock the field effect transistors in the switched capacitor keyers by the use of a two bit binary word. A decay counter decoder 234 is clocked by an appropriate clock train on input 236 and has four outputs 238, 240, 242 and 244. Counter 234 may be of the polynomial, shift register, binary or decimal type, with each of the outputs 238, 240, 242,244 connected to AND gates 246, 248, 250, and 252, respectively. The other inputs of the gates are enabled by the outputs 254, 256, 258 and 260 of binary to decimal decoder 262. The inputs 264 and 266 receive a two bit binary word, which is capable of selecting one of the four outputs 238, 240, 242 and 244 of counter 234 so that the signal on the output 268 of OR gate 270 has four possible frequencies. The noninverted output appears on line 270 and the output is inverted by inverter 272 and appears on line 274, these two latter lines corresponding to lines 250 and 252 in U.S. Pat. No. 4,217,801. Of course, more than four different frequencies could be selected, depending on the number of available outputs from counter 234 and the capacity of the binary to decimal decoder 262. The four possible frequencies of the disclosed embodiment are generally adequate to provide the necessary different sustains wherein binary 11 selects short sustain, binary 10 selects medium short sustain, binary 01 selects medium long sustain, and binary 00 selects long sustain.

The sustains can be selected manually by switches 276 and 278 (FIG. 4), wherein switch 276 is the most significant bit (B sustain) of the binary word and switch 278 represents the least significant bit (A sustain) of the binary word. Sustain control selector 280 selects either the outputs of switches 276 and 278 or the output 282 of snub control circuit 284, which overrides the action of switches 276 and 278 in a manner to be described below. Snub circuit 284 has a first input 286 which carries the delta data pulse from multiplexer 12, and a second input 288, which carries a data steady state signal, which is a very long pulse that remains at one logic level as long as any key on the keyboard 10 is depressed, and goes to the other logic level only when all keys are released. Virtually all present-day electronic organs include circuitry for generating the data steady state pulse and the particular manner in which this pulse is generated forms no part of the present invention. The signal could be generated, for example, by a pair of serially connected D-type flip-flops with the D input of the first flip-flop held at logic 1 and its Q output connected to the D input of the second flip-flop, the output of which carries the steady state pulse. The first flip-flop is clocked by any pulse which appears on the serial data stream from multiplexer 12, is reset by the latch command pulse at the end of the scan, which pulse also clocks the second flip-flop. This very simple circuit arrangement produces a pulse which has a logic 1 as long as a data pulse appears in the serial data stream.

Figure 5:
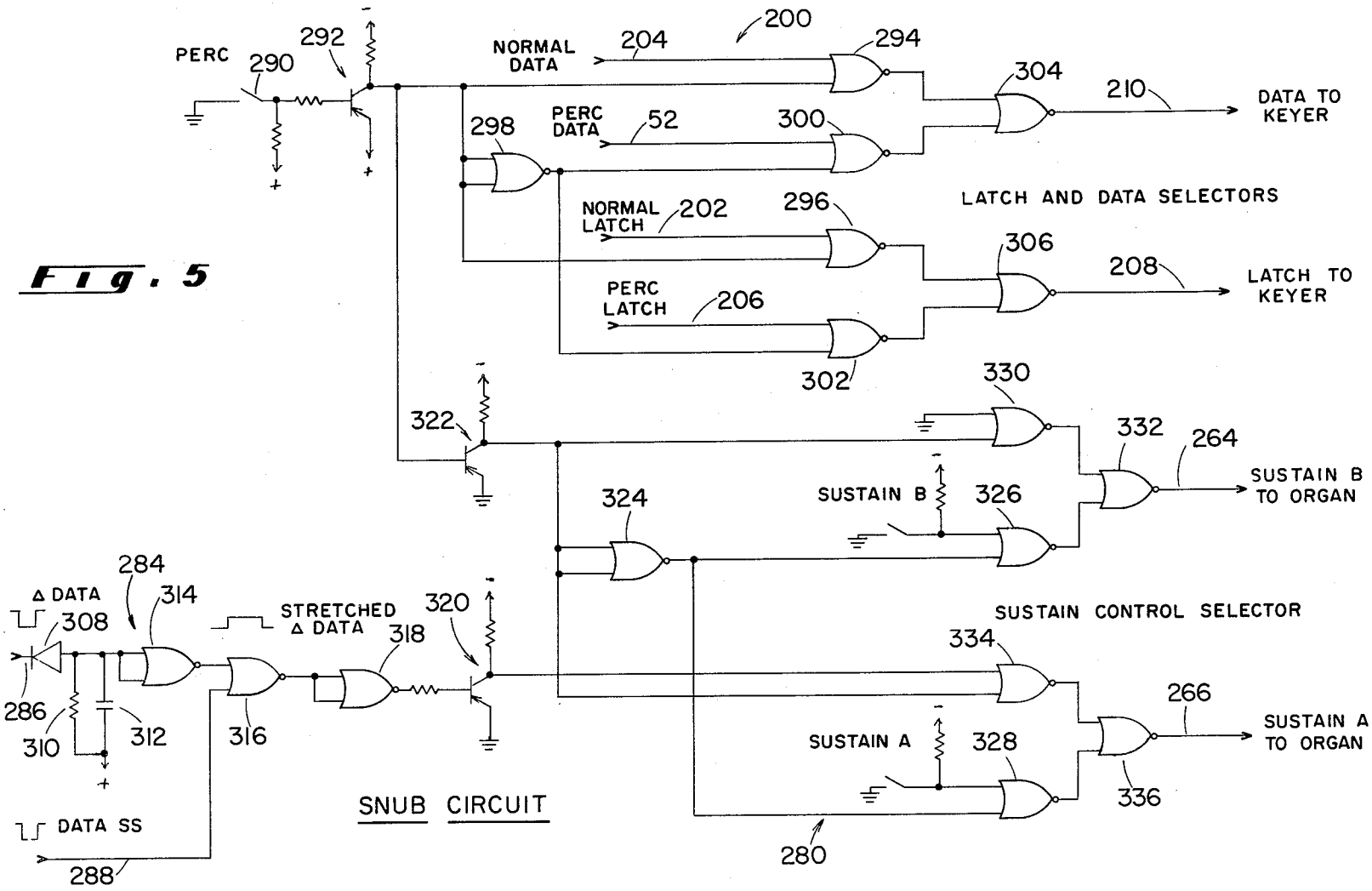
FIG. 5 is a detailed circuit schematic of the snub control circuit.

FIG. 5 illustrates the content of snub control block 284, latch and data selector 200, and sustain control selector 280. When the data is to be percussed by the multiplex percussion generator 46, switch 290 is closed thereby disabling, through transistor 292, NOR gates 294 and 296 which block the normal data on line 204 and normal latch on line 202. Due to the presence of inverter 298, NOR gates 300 and 302 are enabled so that percussion data on line 52 and the percussion latch command on line 206 will be passed to NOR gates 304 and 306, respectively. The data on line 210 and latch command on line 208 are connected to keyer chips 212 wherein the data is demultiplexed and the tones keyed as set forth in the aforementioned U.S. Pat. No. 4,217,801.

The ten millisecond delta data pulse on line 286 is stretched to approximately fifteen milliseconds in width by diode 308, resistor 310 and capacitor 312, inverted by NOR inverter 314 and combined by NOR gate 316 with the inverted data steady state pulse on line 288. The stretched delta data pulse and steady state pulse are inverted by inverter 318 and connected to the base of level shifting transistor 320. The collector of transistor 292 is connected to the base of level shifting transistor 322, and its collector is inverted by NOR gate 324 and functions to disable NOR gates 326 and 328 when the percussion switch 290 is closed. At the same time, NOR gate 330 is enabled so that a logic 0 appears at the output of NOR gate 332. NOR gate 334 is also enabled so that it passes the output of level shifting transistor 320 to the output of NOR gate 336. When a stretched delta data pulse or no data steady state pulse is present at the output of NOR gate inverter 318, the circuitry will produce a logic 1 on the output 266 of NOR gate 336. Because of the enabling of NOR gate 330, this produces a binary 01 on lines 264 and 266, which is decoded by binary to decimal decoder 262 (FIG. 7) and selects the appropriate output 238, 240, 242 or 244 of counter 234 having the appropriate frequency. The effect of the circuit shown in FIG. 5 is to select the higher frequency clocking signal for the field effect transistors in keyers 212 when a binary 01 is produced on outputs 264 and 266 either by the presence of the delta data pulse on line 286 or the absence of the data steady state pulse on line 288. If neither of these conditions is present, then the circuit selects the normal, long sustain by producing a binary 00 on outputs 264 and 266. The output 264 will remain at logic 0 due to the enabling of NOR gate 330, and NOR gates 334 and 336 will pass logic 0 from level shifting transistor 320 when it is turned on by the output of NOR inverter 318.

Figure 6:
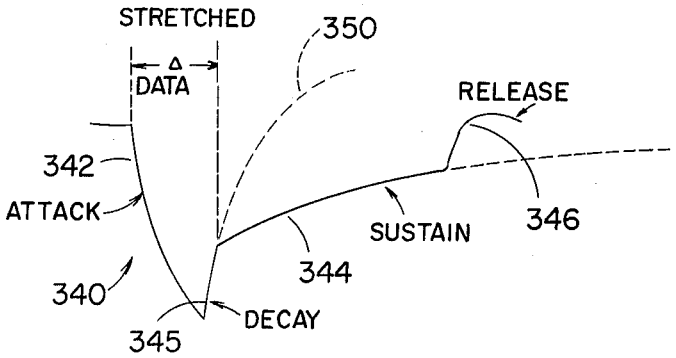
FIG. 6 is a percussive wave form of the type simulating a piano sound.

FIG. 6 illustrates a typical keying envelope wave form 340 having an attack portion 342, a long sustain portion 344, which is produced by the binary 00 output on lines 264 and 266, and a snubbed sustain portion 346, which has a much higher slope than the long sustain portion 344 and will terminate much sooner. The slope of the sustain portion illustrated as 346 is achieved by producing a binary 01 on outputs 264 and 266 due either to the presence of either the delta data pulse or to the absence of the data steady state pulse on lines 286 and 288, respectively.

Assume, for the moment, that a single key is depressed when the organ is in the percussion mode by closing switch 290. The burst of keydown pulses on line 52 from percussion generator are passed by circuit 200 to keyers 212, the appropriate tone is selected by the keyers 212 and is enveloped by the wave shape shown in FIG. 6. The tones begin to attack with an exponential curve during the delta data portion, which is that time during which the burst of keydown pulses are transmitted to keyers 212. Since the delta data pulse is stretched by diode 308, resistor 310 and capacitor 312, it is effective in the snub circuit of FIG. 5 during the initial portion of the decay (after the termination of the burst of keydown pulses), and this forces the snub circuit into a medium short sustain by placing a binary 01 on outputs 264 and 266 as described above. This very rapid decay during the five millisecond portion of the stretched delta data pulse following attack produces the overshoot portion 345 characteristic of the ADSR envelope for a piano sound.

At the termination of the delta data pulse, the circuit of FIG. 5 then switches its output to a binary 00, which selects long sustain thereby producing the sustain portion 344 shown in FIG. 6. This will continue as long as the key is held until the wave form gradually decays to zero. If the key is released in the interim, however, the data steady state pulse on line 288 disappears and the system again goes into the medium short sustain thereby producing the very high slope decay curve 346 shown in FIG. 6. This will occur, however, only if all the keys are released.

Assume now that a number of keys are played in very rapid succession, such as in playing a glissando. Without the snub circuit of FIG. 5, this may cause the sustains of the notes to overlap thereby producing the unpleasant tonal blur described earlier. The delta data pulses present on line 286 switch the system to a medium short sustain thereby causing the wave form of FIG. 6 to decay very rapidly as indicated by line 350. Thus, even though the burst of keydown pulses for all the keys are transmitted to keyes 212, the actual tones produced are snubbed so that there is very little overlap between the sustains of adjacent notes, and when the last note is played and released, the absence of the data steady state pulse will cause the keyers 212 to remain in the snubbed condition so that the sustain of the last note played will be the same as those of the other notes in the glissando.

Figure 8:
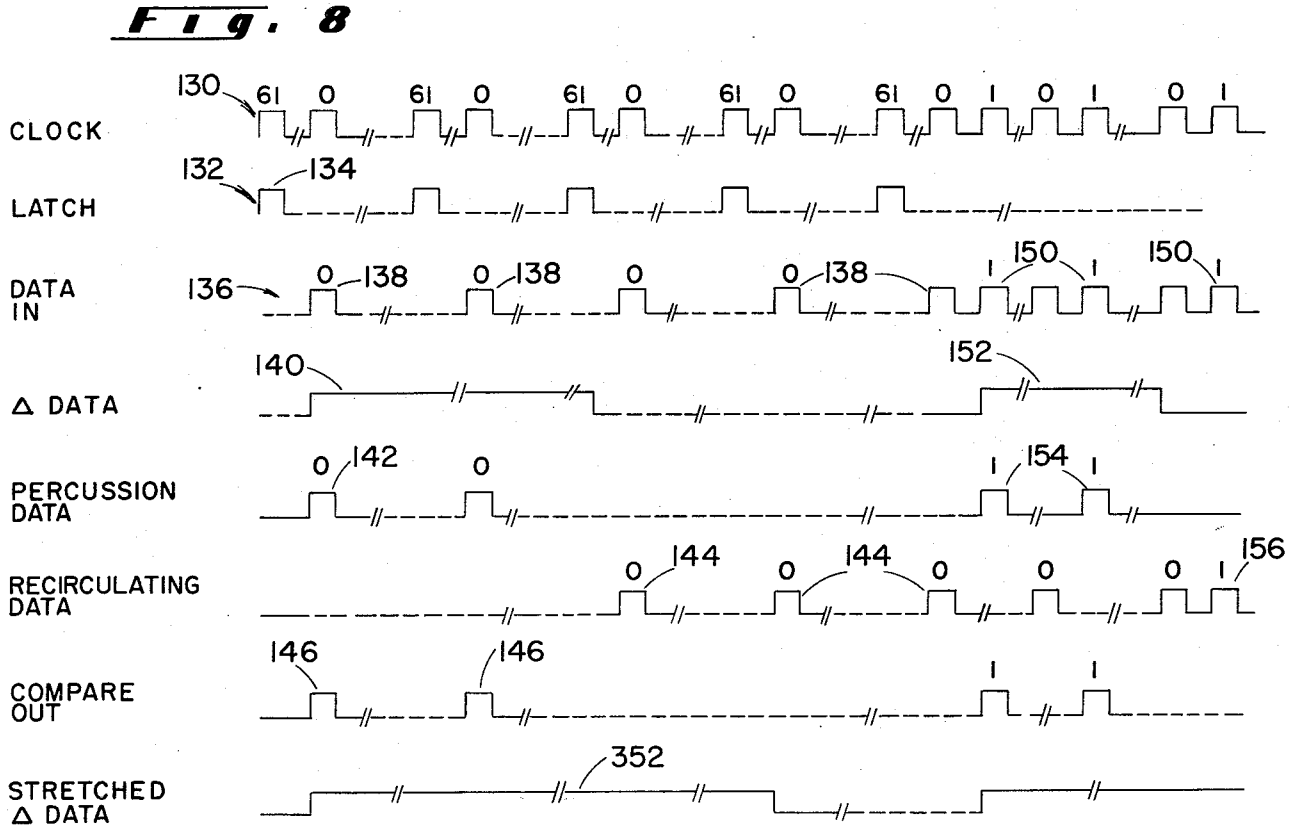
FIG. 8 is a system timing diagram.

The stretched delta data pulse 352 is illustrated in FIG. 8, and it will be seen that it is one and one-half times as long as the delta data pulse 140. Although the delta data pulse 140 is normally five scans in length, it has been shown as only two scans in length in FIG. 8 for the sake of simplicity.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. In an electronic musical instrument including a keyboard having playing keys, multiplex means for repeatedly scanning said keyboard and producing a time division multiplexed serial data stream comprising a cyclically repeating sequence of time slots associated respectively with the keys and keydown pulses in those time slots associated with depressed keys of the keyboard, demultiplex means for demultiplexing the data stream, keyer-tone generator means responsive to the demultiplex means for producing selected tones, and new keydown detect means responsive to key actuation for producing a control pulse each time and only when a key not already depressed is depressed, the control pulse having a pulse width wider than a single scan of the keyboard, a percussion generator interposed between the multiplex and demultiplex means comprising:

a data input connected to the serial data stream, a control input operatively connected to the new key detect means to receive the control pulse, an output operatively connected to the demultiplex means, gating means responsive to the control pulses and to the data stream for passing to said output each keydown pulse in said data stream which first appears in the data stream at the same time as a currently occurring control pulse in present on said control input and continuing to pass said each keydown pulse only substantially as long as said currently occurring control pulse is present on said control input.

2. The electronic musical instrument of claim 1 wherein said gating means includes means for blocking other keydown pulses in the data stream from passing to said output if said other keydown pulses first appeared in the data stream during the occurrence of a control pulse previous to the currently occurring control pulse and have been present in the data stream every scan of the keyboard since said previous control pulse.

3. The electronic musical instrument of claim 2 wherein said means for blocking includes a recirculating register means for dynamically storing said other keydown pulses following termination of said previous control pulse and as long as the keys associated with said other keydown pulses remain depressed.

4. The electronic musical instrument of claim 3 wherein said register means ceases storing any said other keydown pulses when the key associated therewith is released.

5. In an electronic musical instrument including a keyboard having playing keys, multiplex means for repeatedly scanning said keyboard and producing a time division multiplexed serial data stream comprising a cyclically repeating sequence of time slots associated respectively with the keys and keydown pulses in those time slots associated with depressed keys of the keyboard, demultiplex means for demultiplexing the data stream, keyertone generator means responsive to the demultiplex means for producing selected tones, and new keydown detect means responsive to key actuation for producing a control pulse each time a key not already depressed is depressed, the control pulse having a pulse width wider than a single scan of the keyboard, a percussion generator interposed between the multiplex and demultiplex means comprising:

a data input connected to the serial data stream, a control input operatively connected to the new key detect means to receive the control pulse, an output operatively connected to the demultiplex means, gating means responsive to the control pulses and to the data stream for passing to said output each keydown pulse in the data stream which first appears in the data stream substantially at the same time as a currently occurring control pulse is present on said control input and for discontinuing to pass said each keydown pulse to the output when said currently occurring control pulse terminates, register means for dynamically storing said each keydown pulse when said currently occurring control pulse terminates as long as the respective key pertaining to said each keydown pulse remains depressed, said gating means including means responsive to said register means for comparing the data stream with the dynamically stored keydown pulses for preventing passing to the output any keydown pulses in the same time slots as the dynamically stored keydown pulses.

6. The electronic musical instrument of claim 5 wherein said register means includes a recirculating register connected to said gating means and to said means for comparing.

7. The electronic musical instrument of claim 6 wherein said means for comparing comprises an exclusive OR function circuit means for enabling said gating means to pass a keydown pulse to the output only when the data stream and the dynamically stored keydown pulses in the recirculating register compared at that time slot are different.

8. The electronic musical instrument of claim 6 wherein said recirculation register is synchronized with said data stream and comprises stages which number an integer multiple of the number of time slots in one scan of the keyboard.

9. The electronic musical instrument of claim 8 wherein said register is a shift register.

10. In an electronic musical instrument including a keyboard having playing keys, multiplex means for repeatedly scanning said keyboard and producing a time division multiplexed serial data stream comprising a cyclically repeating sequence of time slots associated respectively with the keys and pulses in those time slots associated with depressed keys of the keyboard, there being new keydown pulses and old keydown pulses in the data stream corresponding to new and old key depressions, respectively, demultiplex means for demultiplexing the data stream, keyer-tone generator means responsive to the demultiplex means for producing selected tones, and new keydown detect means responsive to key actuation for producing a control pulse each time a key not already depressed is depressed, the control pulse having a pulse width wider than a single scan of the keyboard, a percussion generator interposed between the multiplex and demultiplex means comprising:

a data input connected to the serial data stream, a control input operatively connected to the new key detect means to receive the control pulse, an output operatively connected to the demultiplex means, gating means responsive to the control pulses and to the data stream for passing to said output each new keydown pulse in the data stream first appearing in the cyclically repeating sequence of time slots substantially at the same time as a currently occurring control pulse is present on said control input and continuing to pass said each new keydown pulse in the cyclically repeating sequence of time slots only substantially as long as said currently occurring control pulse is present on said control input, said new keydown pulses becoming old keydown pulses after the termination of the currently occurring control pulse, and means for storing the old keydown pulses which were in said cyclically repeating sequence of time slots concurrent with control pulses prior to the currently occurring control pulse and continue to appear in said cyclically repeating sequence of time slots concurrent with said currently occurring control pulse due to the keys associated with said other keydown pulses continuing to be depressed.

11. The electronic musical instrument of claim 10 wherein said means for storing other keydown pulses is a recirculating register synchronized with the data stream and having at least as many stages as the number of time slots in said data stream.

12. The electronic musical instrument in claim 11 including means for deleting a keydown pulse from the recirculating register when the key associated with said last mentioned keydown pulse is released, said means for deleting including means for comparing the data stream with the keydown pulses stored in the recirculating register to determine which keydown pulses are to be deleted from the register.

13. In an electronic musical instrument including a keyboard having playing keys, multiplex means for repeatedly scanning said keyboard and producing a time division multiplexed serial data stream comprising a cyclically repeating sequence of time slots associated respectively with said keys and a keydown pulse in that time slot associated with an actuated key of the keyboard, demultiplex means for demultiplexing the data stream, keyer and tone generator means responsive to the demultiplex means for producing tones, and new keydown detect means responsive to said key actuation for producing a control signal when a key not already actuated is actuated, the control signal having a pulse width wider than one scan of the keyboard, a percussion generator interposed between the multiplex means and demultiplex means comprising:

an output operatively connected to the multiplex means, a data input connected to the serial data stream, a control input connected to the new key detect means to receive the control signal, gating means responsive to the control pulse and the data stream for passing said keydown pulse to said output on each repeating sequence of the data stream only for the duration of said control signal, and recirculate means responsive to said data stream and said control signal for recirculating said keydown pulse to said gating means after termination of said control signal and for as long as said keydown pulse continues to appear in said data stream for each repeating sequence thereof, said gating means blocking said keydown pulse from said output as long as the keydown pulse is recirculated to it by said recirculate means even though a new control signal may be produced by said new keydown detect means.

14. The electronic musical instrument of claim 13 wherein said recirculation means includes means for comparing said data stream with the recirculating keydown pulse on a time slot by time slot basis and detecting from said recirculate means any keydown pulse which does not appear in said data stream due to release of the key associated with that keydown pulse.

15. The electronic musical instrument of claim 14 wherein said means for comparing controls said gating means to load into said recirculate means a keydown pulse in said data stream which occurs after termination of said control signal and which is not already present in said recirculate means.

16. The electronic musical instrument of claim 15 wherein said recirculate means comprises a shift register and a gate connected in a recirculate path of said shift register having a control input connected to said means for comparing, and said gating means comprises a first gate circuit having a first control input connected to said means for comparing, a data input connected to said data stream, and a second control input connected to said control pulse.

17. In an electronic musical instrument including a keyboard, multiplex means for repeatedly scanning said keyboard and producing a time division multiplexed serial data stream comprising a cyclically repeating sequence of time slots associated respectively with said keys and pulses in those time slots associated with depressed keys of the keyboard, new keydown detect means responsive to key actuation for producing a control pulse each time a key not already depressed is depressed, the control pulse having a pulse width wider than a single scan of the keyboard, percussion generator means operatively connected to and responsive to a keydown pulse in a time slot of said data stream for producing a percussion stream synchronized with said data stream and comprising a burst of pulses in repeated occurrences of said time slot only for the duration of said control pulse regardless of whether said keydown pulse continues to appear in said time slot in said data stream due to continued depression of the associated key, and tone generator-keyer means responsive to said percussion stream for producing a tone corresponding to said burst of pulses and having an amplitude envelope with an attack portion and a decay portion, said tone generator-keyer means including means for controlling the length of the decay portion of the envelope, a snub control circuit comprising: an input responsive to said control pulse, and means connected to said tone generator-keyer means for controlling the tone generator-keyer means to produce an envelope of a first decay duration while said control pulse is present on the input of said tone generator-keyer means and to produce an envelope of a second decay duration longer than said first duration when said control pulse is not present on the input.

18. The electronic musical instrument of claim 17 wherein said new keydown detect means produces a said control pulse having a duration which encompasses substantially the entire attack portion of the envelope and the initial part of the decay portion thereof.

19. In an electronic musical instrument comprising a keyboard having playing keys, percussion generation means responsive to the depression of keys to produce percussion keying signals corresponding to the depressed keys, and tone generator-keyer means responsive to the keying signals for producing tones of frequency corresponding to the keying signals, an envelope control circuit connected to said tone generator-keyer means comprising:

means responsive to the depression of the playing keys for controlling said tone generator-keyer means to impart a percussion amplitude envelope to the tones produced thereby having an attack portion of increasing amplitude and a decay portion of decreasing amplitude, said means for controlling including selection means for selecting a sustain portion for all depressed keys of either a first duration or of a second duration shorter than said first duration, and means responsive to the depression of any key not already depressed for producing a control pulse, said selection means being responsive to said control pulse automatically for selecting sustain of said second duration for the duration of said control pulse, and then automatically selecting sustain of said first duration after the termination of said control pulse and while any key remains depressed.

20. The musical instrument of claim 19 wherein said envelope control circuit includes means responsive to the release of all keys to select said short sustain.

* * * * *